US011905086B2

(12) United States Patent
Guéry et al.

(10) Patent No.: US 11,905,086 B2
(45) Date of Patent: Feb. 20, 2024

(54) CAP ASSEMBLY FOR A REFILL CONTAINER

(71) Applicant: BNOVA SA, Wierde (BE)

(72) Inventors: Jean Claude Guéry, Wierde (BE); Corinne Herlin, Strasbourg (FR)

(73) Assignee: BNOVA SA, Wierde (BE)

( * ) Notice: Subject to any disclaimer, the term of this patent is extended or adjusted under 35 U.S.C. 154(b) by 0 days.

(21) Appl. No.: 17/658,464

(22) Filed: Apr. 8, 2022

(65) Prior Publication Data

US 2023/0294888 A1 Sep. 21, 2023

(30) Foreign Application Priority Data

Mar. 17, 2022 (LU) ..... 510678
Mar. 21, 2022 (EP) ..... 22163177

(51) Int. Cl.
*B65D 51/28* (2006.01)
*B65D 81/32* (2006.01)

(52) U.S. Cl.
CPC ..... *B65D 51/2892* (2013.01); *B65D 51/285* (2013.01); *B65D 81/3205* (2013.01)

(58) Field of Classification Search
CPC ..... B65D 51/2892; B65D 81/3211; B65D 81/3205; B65D 51/285
USPC ..... 206/219, 221
See application file for complete search history.

(56) References Cited

U.S. PATENT DOCUMENTS 5,533,553 A * 7/1996 Vesborg ..... B65D 1/0223 141/366
7,055,685 B1 * 6/2006 Patterson ..... B65D 51/2892 215/DIG. 8
9,919,860 B2 * 3/2018 Dabah ..... B65D 51/2821
2003/0024830 A1 * 2/2003 Sharon ..... B65D 81/3205 220/8
2005/0205151 A1 9/2005 Behar
2007/0181449 A1 8/2007 Hamamoto et al.
2007/0277902 A1 12/2007 Dieudonat et al.
2008/0067084 A1 * 3/2008 Patterson ..... B65D 51/2892 206/219
2010/0016826 A1 * 1/2010 Billiet-Prades ..... A61J 1/2089 604/416
2015/0251837 A1 * 9/2015 Krammer ..... B65D 51/2835 53/474

(Continued)

FOREIGN PATENT DOCUMENTS

FR 2707601 A3 1/1995
JP 07096979 11/1995

*Primary Examiner* — Steven A. Reynolds
(74) *Attorney, Agent, or Firm* — Daniel C. Pierron; Widerman Malek, PL

(57) ABSTRACT

A cap assembly for a refill container, including an interface member and a movable sealing element retained in the interface member. The interface member may include a socket, a conduit arranged inside the socket forming a discharge opening, and a connecting wall extending between the socket and the conduit. The interface member may further include at least one abutment element arranged inside the conduit, the abutment element cooperating with the sealing element to position it in a closed position in which the discharge opening is sealed. The sealing element may include a body with a first end including a cap. The body and/or the cap may include a lateral wall with a sealing surface arranged inside the conduit.

16 Claims, 7 Drawing Sheets

(56) References Cited

U.S. PATENT DOCUMENTS

| | | | | |
|---|---|---|---|---|
| 2018/0009590 | A1* | 1/2018 | Wong | B65D 1/0246 |
| 2018/0208372 | A1* | 7/2018 | Rovelli | B65D 51/285 |

* cited by examiner

CAP ASSEMBLY FOR A REFILL CONTAINER

This application claims priority to Luxembourg Patent Application No. LU510678 filed Mar. 17, 2022. This application also claims priority to European Patent Application No. 22163177.3 filed Mar. 21, 2022.

FIELD OF THE INVENTION

The disclosure relates to the area of devices adapted to dispense a product and such as a liquid, a cream or a powder from a first to a second container. More particularly, the disclosure relates to a cap assembly which can be used with a first and a second container allowing to refill the second container with a product contained in the first container, for example to prepare a solution in situ.

BACKGROUND OF THE INVENTION

In different fields such as cleaning or hygiene, cosmetics, agriculture or food, some products are supplied in ready-to-use concentrations in a plastic or glass container, for example in a plastic bottle.

Typically, such products comprise a predetermined quantity of one or more concentrated ingredients diluted a greater quantity of a solvent (such as water) to obtain a final product concentration that is suitable for use in a home or commercial environment. The concentrated product may commonly be a liquid, a cream, a powder, or a granular product made of microcapsules comprising a solid ingredient.

Once the product is depleted, the container may be refilled for re-use by manually diluting a predetermined volume of a product comprising concentrated active ingredients with a solvent.

To reduce the waste, such as plastic waste, generated by discarding empty bottles and to reduce the costs and resources required to ship and store ready-to-use products, refill systems are needed for commercial or industrial products bottles.

Generally, the exact amount of concentrated product added to the solvent must be precisely measured to obtain a final product that keeps its active properties without becoming hazardous. In some cases, the concentrated ingredient should not be spilt or let in contact with other surfaces than their containers as they may be dangerous for the health and may also damage other surfaces. Therefore, when refilling cleaning products, the end-user must carefully handle the bottle of concentrated product to pour it without spilling outside of the empty bottle.

For example, in case of detergents, to obtain a safe and efficient cleaning liquid, the quantity of the concentrated product must be cautiously controlled.

All these constraints hinder the development of widely available refill systems that are suitable and convenient for use in domestic and professional settings.

The document U.S. Pat. No. 7,055,685 discloses a mixing cap which comprises an apertured inner tube threadably-engagable to the mouth of a bottle, and an outer housing cooperatively-engaged to the inner tube and slidably-restricted thereover via a flange arrangement. The combined ingredients and liquid within the bottle may subsequently be shaken without fear or risk of leakage or spillage.

WO 2022/008431 discloses a recipient comprising a reservoir, the reservoir having a bottom wall comprising an opening; a central element arranged at the opening of the reservoir; a socket arranged to surround the central element; wherein the recipient is a blow-molded article; wherein both the socket and the central element show a lower end and an upper end, and are connected by their respective upper ends by means of a disc with a central aperture, wherein the assembly comprising the socket, the central element and the disc is forming a ring that comes into one piece in that at least a part of the bottom wall of the reservoir is arranged to face the disc and in that the ring and the reservoir also come into one piece so that the reservoir is irreversibly fixed to the ring.

Cap systems for a concentrated refill capsule are disclosed in documents WO 2020/239612, and WO 2020/239617. The documents describe a cap system with a cap assembly comprising an outer wall, and an inner wall connected to the outer wall via a connecting wall and defining a conduit through the cap assembly. The conduit is closed by a closure member fixed to the inner wall by means of a frangible zone. The system further comprises a plug movably mounted inside the inner wall. A container or capsule may be attached to both sides of the outer wall of the cap assembly. To allow a liquid or powder product through the cap assembly, a neck of the container pushes the plug against the closure member thereby breaking the frangible zone and opening the conduit.

The above cap system is complex and to open the conduit, the closure member is freed inside the container. During the passage of the product, the loose closure member may come back to its previous position disturbing the flow of the product through the conduit. This may be even more problematic if the flowing product is a viscous liquid such as a cream or if the flowing product is a powder.

There is still a need for improvements to the refill devices. It is therefore an object of the present invention to provide a cap assembly for a refill container that overcomes at least partially the above-mentioned disadvantages. In particular, it is an object of the invention to provide a cap assembly for a refill container that allows a user to safely and reliably deliver a predetermined volume of a product to a container for dilution, with improved reliability and reduced complexity.

SUMMARY OF THE INVENTION

According to a first aspect, the disclosure provides for a cap assembly for a refill container, the cap assembly comprising an interface member, and a sealing element retained in the interface member; wherein the interface member comprises a socket, a conduit forming a discharge opening arranged inside the socket and spaced from the socket, and a connecting wall extending between the socket and the conduit to prevent flow between the socket and the conduit; the conduit having an upstream end and a downstream end; wherein the sealing element is arranged to be partly inside the conduit and is moveable between a closed position in which the conduit is sealed, and an open position in which flow is allowed through the conduit; wherein the cap assembly is remarkable in that the interface member further comprises one or more abutment elements arranged in the conduit or at the upstream end of the conduit and are configured to keep the conduit partially open, wherein the one or more abutment elements cooperate with the sealing element to position it in the closed position; in that the sealing element comprises a body with a first end and a cap; the cap being arranged at the first end of the body wherein the body and/or the cap comprises a lateral wall with a sealing surface configured to cooperate with an inner wall of the conduit to seal it when the sealing element is in the closed position; and wherein the sealing element further comprises at least one aperture and/or at least one recess forming a passage through which flow can occur when the sealing element is in the open position.

From the definition given, it is understood that the disclosure provides a cap assembly that is easy and cost-effectively produce. The cap assembly is to be connected to a first container by its upstream part and to a second container by its downstream part. Initially, the sealing element is in the closed position allowing the first container to be connected to the cap assembly in a sealed way. The sealing element is pushed from its closed position to its open position by a pressure exerted by the neck of the second container on the bearing surface of the sealing element. The sealing element is not broken when displaced. The displacement of the sealing element pushes the sealing surface outside the conduit to allow flow through the conduit. Since nor the sealing element nor the interface need to be broken to be opened, no free and uncontrolled element can disturb the flow of the product. The cap assembly is simple with only one element for the sealing.

In a preferred embodiment, the sealing element further comprises at least one ring or at least two protrusions extending outward from the body and comprising a bearing surface.

In embodiments, the body of the sealing element is a hollow tubular body or a solid rod body with a round or cross-formed cross-section.

In an embodiment, the body of the sealing element is a solid rod with a round or a cross-formed cross-section, and the sealing surface is a ledge formed around the cap of the sealing element.

In an embodiment, the body of the sealing element is a hollow tubular body closed at one end by the cap and the inner diameter of the conduit is greater than the outer diameter of the body of the sealing element to define a passage between the conduit and the body in which flow is allowed and the sealing surface of the sealing element is formed by a shoulder on the hollow tubular body; with preference, the shoulder is arranged at the first end of the hollow tubular body and/or the first end of the hollow tubular body is closed by the cap. In such configuration difference of diameter between the shoulder and the body forms a recess defining a passage through which a flow can occur.

In embodiments, the one or more abutment elements of the interface member are elastically deformable tabs and form snap-fit elements, and the sealing element comprises means to cooperate with the snap-fit elements to retain it in the open position; with preference, the snap-fit elements are annular snap-fit elements, cantilever snap-fit elements or torsional snap-fit elements.

Alternatively, or in complement, the sealing element further comprises snap-fit elements configured to cooperate with corresponding means on the conduit and configured to retain the sealing element in the opened position when the sealing element has been moved from its closed position to its opened position.

In embodiments, the conduit shows a central axis and the one or more abutment elements of the interface member are legs that extend in the direction of the central axis of the conduit.

In embodiments, the conduit shows a central axis and the interface member comprises one abutment element being a leg fixed at both ends to the conduit wherein one end is fixed to the conduit by a frangible zone; with preference, the abutment elements extend through the axis and/or one end is fixed to the conduit by a non-frangible zone.

In embodiments, the sealing element further comprises snap-fit elements configured to cooperate with corresponding means on the conduit and configured to retain the sealing element in the open position when the sealing element has been moved from its closed position to its open position.

In embodiments, the body is a hollow tubular body, the conduit shows a central axis and the one or more abutment elements of the interface member are pins or an inner hoop fixed to the conduit and in the direction of the central axis of the conduit and the body of the sealing element comprises a first recess configured to cooperate with the pins or with the inner hoop to position and maintain the sealing element in the closed position; with preference, the sealing element comprises a second recess configured to cooperate with the pins or with the inner hoop of the interface member to position and maintain the sealing element in the open position when the sealing element has been moved from its closed position to its open position.

In embodiments, the socket of the interface member comprises an upstream part on one side of the connecting wall inside of which is arranged the upstream end of the conduit and a downstream part on the other side of the connecting wall inside of which is arranged the downstream end of the conduit, wherein the downstream part and/or the upstream part of the socket comprises at least one internal relief; preferably at least on internal relief is an internal thread or a hoop.

In embodiments, the upstream part of the socket comprises an internal thread and further comprises at least one holding relief on the inner wall and/or the downstream part of the socket comprises at least one internal relief selected from an internal thread or an internal hoop, and at least one ring extending radially outward from the body of the sealing element further comprises holding lugs configured to cooperate with the internal relief of the socket to maintain the sealing element in the closed position.

In embodiments, the sealing element comprises a hollow tubular body, at least one aperture is formed in the lateral wall of the body between the sealing surface and the second end of the body and/or in an annular rim that extends outward from the second end of the body.

In embodiments, the one or more abutment elements are fixed to the conduit and/or the conduit comprises a flexible tapered end.

According to a second aspect, the invention provides for an interface member for a cap assembly according to the first aspect, the interface member comprises a socket, a conduit forming a discharge opening arranged inside the socket and spaced from the socket and a connecting wall extending between the socket and the conduit to prevent flow between the socket and the conduit; the conduit having an upstream end and a downstream end, remarkable in that it further comprises one or more abutment elements arranged in the conduit or at the upstream end of the conduit and are configured to keep the conduit partially open.

According to a third aspect, the invention provides for a sealing element for a cap assembly according to the first aspect, the sealing element comprises a body with a first end and a cap, the cap being arranged at the first end of the body; wherein the body and/or the cap comprises a lateral wall with a sealing surface, wherein the sealing element further comprises at least one aperture and/or at least one recess forming a passage allowing flow. With preference, the sealing element further comprises at least one ring or at least two protrusions extending radially outward from the body, and comprising a bearing surface.

According to a fourth aspect, the invention provides for a set comprising a container and a cap assembly. The set is remarkable in that the cap assembly is according to the first aspect; with preference, the container comprises a neck with a first external relief and a second external relief, and the socket of the interface member comprises an upstream part on one side of the connecting wall inside of which is arranged the upstream end of the conduit wherein the upstream part of the socket comprises an internal thread and further comprises at least one holding relief on the inner wall, and the internal thread of the socket cooperate with the first external relief of the neck of the container to screw the container into the cap assembly, and the holding relief of the socket cooperates with the second internal relief of the neck to fix the cap assembly on the container.

BRIEF DESCRIPTION OF THE DRAWINGS

Other aspects and advantages of the disclosure will be clearer after reading the following detailed description taken in conjunction with the drawings provided, in which:

FIG. 2 is a blank view of a Y of the X of FIG. 1.

DETAILED DESCRIPTION OF THE INVENTION

In the following description, the term "comprise" is synonymous with "include" and is not limiting in that it allows the presence of other elements in the container or the movable sealing means. It is understood that the term "comprise" includes the wording "consist of".

Similarly, the terms "inferior", "superior", "second", "higher" and "first" will be understood about the general orientation of the cap assembly when used to dispense a product into a container. Thus, "second" will mean greater ground proximity than "higher" or "first" along the vertical axis.

The term "part" is understood as a section of a piece.

In the different figures, the same references designate identical or similar elements.

Figure 1:
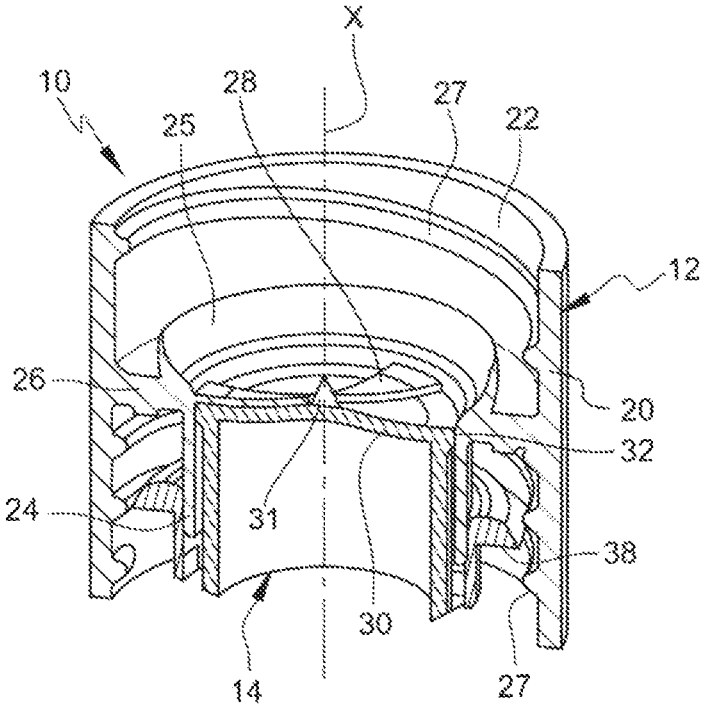
FIG. 1 is a cross-sectional perspective view of a cap assembly according to an embodiment of the invention.

A cap assembly 10 for a refill container, comprises an interface member 12, and a movable sealing element 14 arranged inside the interface member, as shown in FIG. 1.

Figure 2:
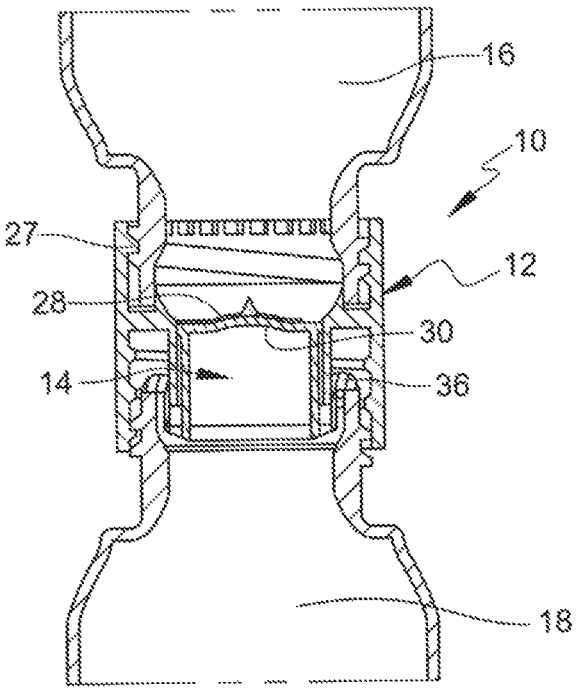
FIG. 2 is a cross-sectional view of the cap assembly of FIG. 1 arranged between two containers, in the closed position of the sealing element.
Figure 3:
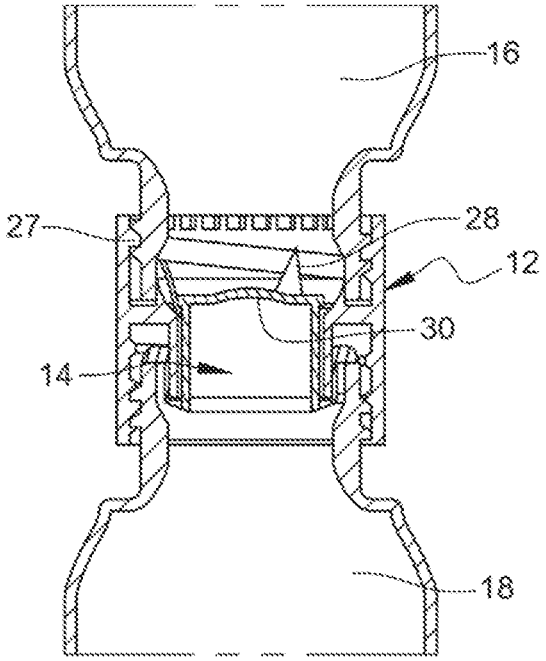
FIG. 3 is a cross-sectional view of the cap assembly of FIG. 1 arranged between two containers, in the open position of the sealing element.

As shown in FIGS. 2 and 3, the interface member 14 is configured to be used as an interface between a first container 16 such as a bottle or a capsule, and a second container 18, that may be for example a bottle. For example, the first and second containers may be bottles comprising a neck that is inserted, respectively from both ends of the interface member 14.

One container can comprise a fluid or a granular product, such as a liquid, a cream, a powder or microcapsules, comprising concentrated active ingredients that have to be diluted in a solvent comprised in the other container; for example, the solvent is water.

The interface member 12 and the sealing element 14 are molded articles. The interface member 12 and the sealing element 14 can be made of the same material or of different materials. With preference, the interface member 12 and the sealing element 14 are made of different materials.

For example, the interface member 12 and/or the sealing element 14 are made of plastic material being a thermoplastic material selected from polyester, polyethylene, polypropylene, polystyrene, polylactide and any mixture thereof; preferably is made of plastic material being one or more polyester, more preferably being or comprising polyethylene terephthalate.

For example, the interface member 12 and/or the sealing element 14 are made of a plastic material comprising at least 30 wt. % of post-consumer resin based on the total weight of the plastic material; with preference, at least 40 wt. %; or at least 50 wt. %; or at least 60 wt. %; or is entirely made of post-consumer resin (i.e. 100 wt. %). For example, wherein the post-consumer resin is a blend of recycled polypropylene and recycled polyethylene, the content of the recycled polyethylene is ranging from 2 to 20 wt. % relative to the total weight of the post-consumer resin. For example, wherein the post-consumer resin is a blend of recycled polypropylene and recycled polyethylene, the content of the recycled polypropylene is ranging from 2 to 20 wt. % relative to the total weight of the post-consumer resin.

The interface member 12 comprises a socket 20, with an inner wall 22, and an outer wall opposite to the inner wall. The outer wall may comprise ribs, gripping material, a hexagonal or a squared shape to facilitate its manipulation by the user.

The socket 20 may be cylindrical, and it may comprise at least two cylinders of different diameters with one central axis.

The interface member 12 comprises an upstream part (i.e., upstream relative to a flow of the product) and a downstream part (i.e., downstream relative to a flow of the product). The upstream part is intended to be connected to the container (i.e., the first container) comprising the concentrated product that is to be diluted in the solvent contained in the other container (i.e., the second container). The downstream part is intended to be connected to the second container. For example, the first container 16, arranged on top in FIGS. 2 and 3, contains the product that has to be diluted in the solvent of the second container 18, arranged in the bottom in FIGS. 2 and 3. The skilled person understands that it may be the other way around. The transfer of the product between the first and second containers (16, 18) is made by gravity. As it will be seen in detail the transfer of the product can also withstand some pressure such as the pressure made by the user when pressing the first container since the sealing element is retained in the open position when reaching it.

The interface member 12 comprises a conduit 24 forming a discharge opening arranged inside the socket and spaced from the socket 20. The conduit is a tubular conduit with a central axis X as shown in FIGS. 1 to 3, and 8.

In embodiments, as shown in FIGS. 1 to 3, and 8, the conduit may comprise a flexible tapered end 25 configured to cooperate with a container. For example, in FIGS. 2 and 3, the flexible tapered end 25 cooperates with the first container 16 to create a liquid-tight connection between the first container 16 and the interface member 12.

The interface member 12 further comprises a connecting wall 26 extending between the socket 20 and the conduit 24 to prevent flow between the socket and the conduit. The connecting wall 24 creates a liquid-tight connection between the socket and the conduit. It may be a radial annular wall or a cylinder that is preferably shorter than the conduit 24 such that it creates a void space between the conduit and the socket.

The conduit 24 comprises an upstream end and a downstream end, relative to the product flow. The connecting wall 26 may be arranged between the upstream part and the downstream parts of the interface member, and the upstream and downstream ends of the conduit may be arranged respectively in the upstream and downstream parts of the interface member.

The sealing element 14 is arranged partly inside the conduit 24 and is moveable between a closed position in which the conduit is sealed and an open position in which flow is allowed through the conduit.

The interface member 12 further comprises one or more abutment element 28 arranged inside the conduit 24 or at the upstream end of the conduit 24, in both cases the one or more abutments elements 28 are configured to keep the conduit partially open. The one or more abutments elements 28 may partially close the conduit without obstructing it. The one or more abutment elements 28 cooperate with the sealing element 14 to position it in a closed position in which the discharge opening (i.e., the conduit 24) is sealed.

The abutment element 28 may be any element fixed to the conduit 24, it may be a monolithic protrusion or a part fixed to the conduit 24 by solder, glue, or clamping means. Preferably, the abutment member is made in one piece with the interface member. For example, the abutment element 28 may be a radial strip connected from both ends to the conduit 24 and arranged along a diameter of the conduit when it is a right circular cylinder.

As an option, the interface member 12 includes an injection structure. The injection structure (not illustrated) comprises a cross shape with a central injection point 31. This center point 31 is used for injecting plastic during the molding process used for manufacturing the interface member 12. The cross structure includes branches distributed about the center point 31, and are connected to the conduit 24, for instance at its upstream end. The injection branches are angularly distributed about the central injection point 31, they foster a homogeneous plastic flow in the mold.

When the injection structure is arranged at the upstream end of the conduit, they are at distance from the closing surface of the sealing element in the closed position. Thus, the injection structure eases the molding process without hindering the opening motion of the sealing element.

The sealing element 14 comprises a body with a first end and a cap 30 with the cap being arranged at the first end of the body. The cap 30 may be a flat radial plate, or it may have any type of concave or convex shape. When the body is a hollow tubular body, the cap is sealing the first end of the tubular body. As shown in FIGS. 1 to 5, 6, and 10, the cap 30 may be cylindrical. As an alternative, the cap is tapered or has a conical or frustoconical shape, extending from a base to a peak, for example, wherein the peak is oriented toward the upstream side of the interface member 12.

The body of the sealing element 14 comprises a lateral wall with a sealing surface 32 configured to cooperate with an inner wall of the conduit 24 to seal it when the sealing element is in the closed position. In an alternate or complementary manner, the cap of the sealing element 14 comprises a lateral wall with a sealing surface 32 configured to cooperate with an inner wall of the conduit 24 to seal it when the sealing element is in the closed position.

The sealing element further comprises at least one aperture 34 and/or at least one recess forming a passage allowing flow through the conduit when the sealing element is in the open position, and preferably at least one ring 36 or at least two protrusions extending outward from the body and comprising a bearing surface 38. The bearing surface 38 is configured to cooperate with a neck of the second container. Indeed, the neck of the second container will place itself in abutment against the bearing surface 38 to push the sealing element 14 from its closed position to its open position.

The body of the sealing element 14 may be a hollow tubular body or a solid rod. The rod may have a round or cross-form cross-section. A cross-form cross-section may be formed from ribs extending along at least part of a central rod. The ribs may extend substantially parallel with the axis along which the rod extends. The cross-form cross-section provides rigidity to the rod without significantly increasing manufacturing complexity.

The sealing element 14 is moveable inside the conduit 24 by a pressure exerted on the bearing surface 38. In the closed position, as shown in FIG. 2, the sealing surface 32 is in sealing contact with the inner surface of the conduit 24 of the interface member 12, sealing the conduit 24. In the open position, as shown in FIG. 3, the lateral sealing surface 32 is out of the conduit and therefore not in contact anymore with the inner surface of the conduit 24 allowing the liquid or powder product to flow through the discharge opening (i.e., the conduit) of the interface member 12 through the at least one aperture 34 and/or the at least one recess of the sealing element 14. In the open position the sealing surface 32 is placed at distance from the conduit 24.

The sealing element 14 may move inside the conduit 20 by a simple translation along an axis of the interface member 12, or by a translation combined with a rotation around the axis of the interface member 12.

When using the cap assembly 10 in cooperation with the first and second container (16, 18), the second container 18, downstream from the flow of the product exerts a pressure on the bearing surface 38, to allow the sealing element 14 to move inside the conduit 24 until the sealing surface 32 gets out of the conduit 24. The sealing element 14 overcomes the maintaining effect of the one or more abutment elements 28.

The sealing surface 32 may be any surface of the sealing element that is complementary to the inner wall of the conduit 24. The sealing is obtained by the contact between the sealing surface 32 of the sealing element 14 and the inner wall of the conduit 24 of the interface member. For example, when the body is a hollow tubular body as shown in FIGS. 1 to 5, 6, and 10, the sealing surface 32 is a shoulder, such that in the closed position of the sealing element, the lateral sealing surface is in sealing contact with the conduit 24. In an embodiment, the body is a hollow tubular body and the shoulder is arranged at the first end of the hollow tubular body, closer to the cap 30.

To form that shoulder, the inner diameter of the conduit 24 may be greater than the outer diameter of the hollow tubular body of the sealing element 14. This will also define a passage between the conduit and the hollow tubular body in which flow is allowed when the sealing surface 32 is out of the conduit 24.

Figure 11:
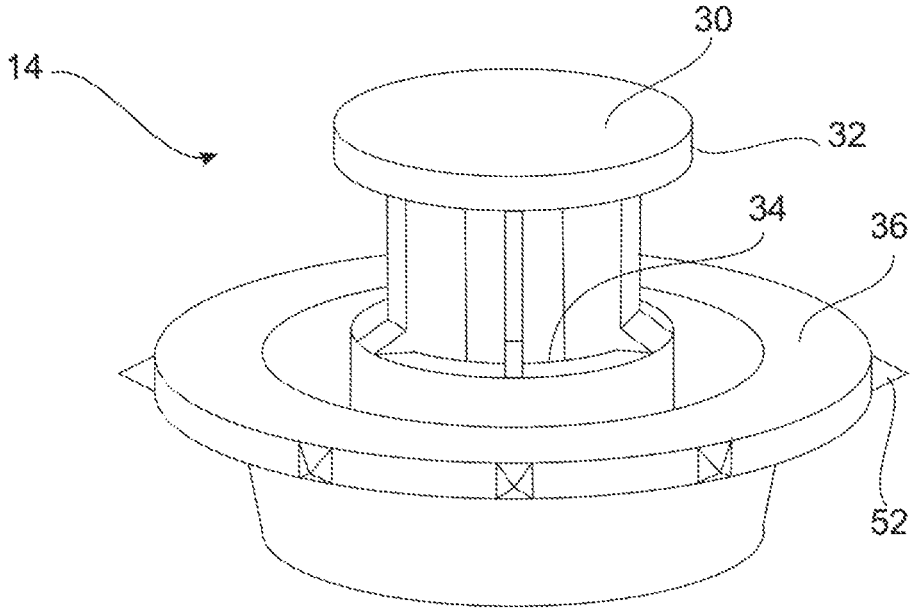
FIG. 11 is a perspective view of a sealing element according to another embodiment of the invention.
Figure 12:
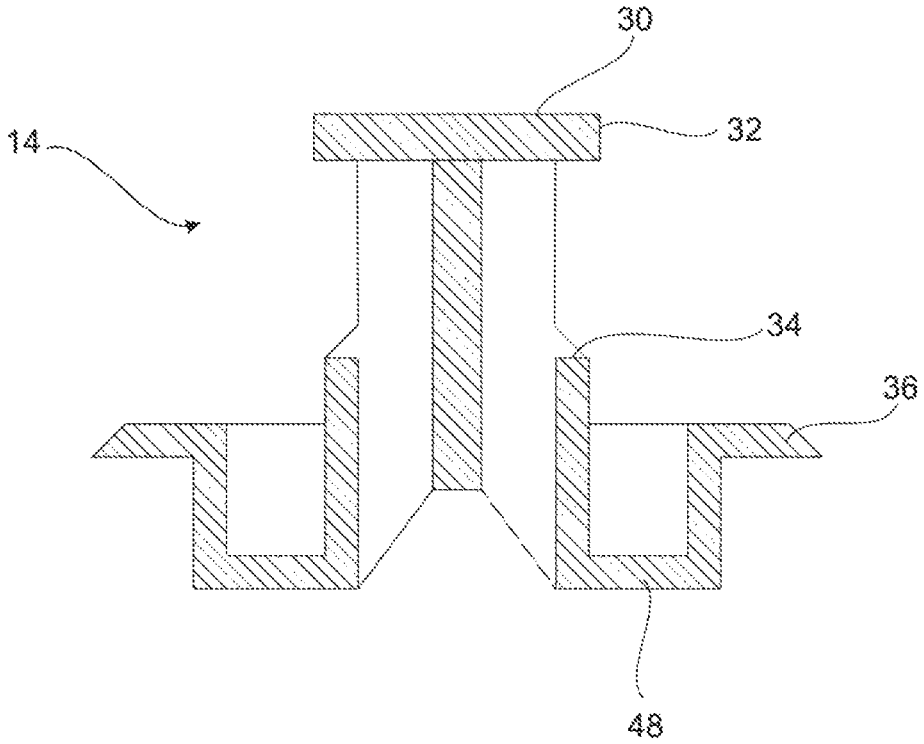
FIG. 12 is a cross-sectional side view of the sealing element according to FIG. 11.

In another embodiment, the body is a solid rod with a round or a cross-formed cross-section, and the sealing surface 32 is a ledge formed around the cap of the sealing element, as shown in FIGS. 11 and 12 or by a shoulder closer to the cap 30.

In other embodiments, not shown, the conduit of the interface member comprises a shoulder, and in the closed position of the sealing element, the lateral sealing surface is in sealing contact with the annular projection of the conduit. In this case, the sealing element may be a hollow tubular body and comprise axial grooves arranged downstream of the sealing surface to allow the flow in the open position of the sealing element.

For example, the sealing surface of the sealing element may be a tapered projection, protruding out of the hollow tubular body of the sealing element.

In other embodiments, not shown, the sealing element may comprise an annular gasket, wherein the gasket comprises the lateral sealing surface.

In the closed position of the sealing element, the cap 30 of the body of the sealing element 14 may be in abutment against at least one abutment element 28. The one or more abutment elements 28 may then be configured such that a predetermined pressure is required from the sealing element to be removed or bent, such that the sealing element move to its open position.

In embodiments, as shown in FIGS. 1 to 3, the interface member 12 comprises a plurality of abutment elements 28 formed by flaps connected to the conduit 24 and further connected at the center of the conduit 24.

Preferably, the socket 20 and the conduit 24 are coaxial with the common axis X, and an abutment element 28 extends inside the conduit 24, through the axis X, as shown in FIGS. 1 to 3.

The one or more abutment elements 28 of the interface member may be legs that extend in the direction of the central axis of the conduit 24. In embodiments, not shown, the interface member may comprise one abutment element being a leg fixed at both ends to the conduit wherein one end is fixed to the conduit by a frangible zone. For example, the abutment element may extend through the axis of the conduit and/or one end is fixed to the conduit by a non-frangible zone.

Figure 8:
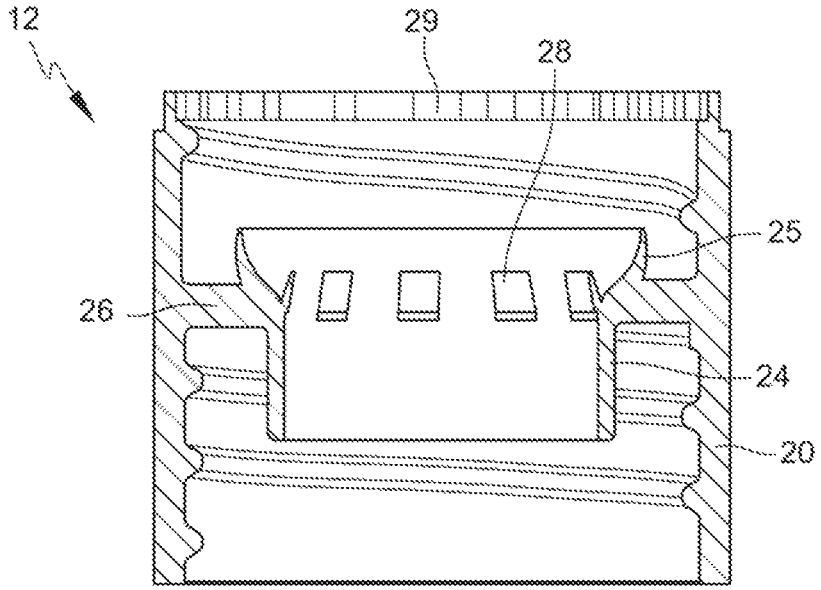
FIG. 8 is a cross-sectional view of an interface member of FIG. 7.
Figure 9:
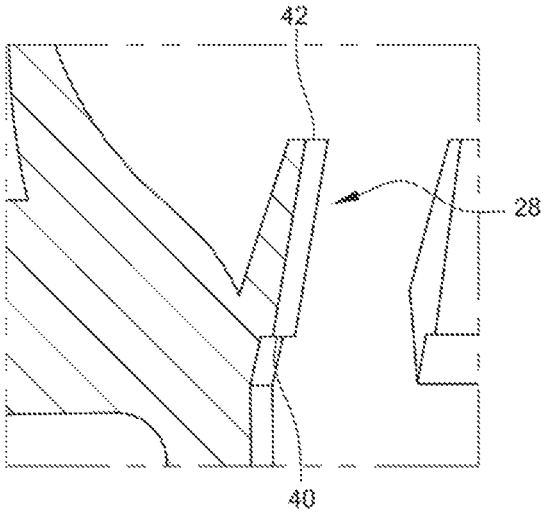
FIG. 9 is a detailed view of FIG. 8 showing an abutment element.
Figure 10:
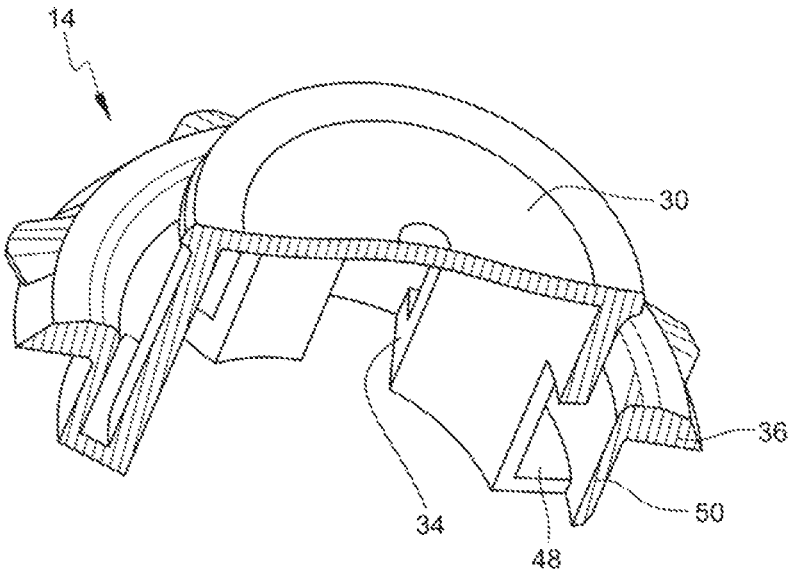
FIG. 10 is a cross-sectional top perspective view of a sealing element according to another embodiment of the invention.

The one or more abutment elements 28 of the interface member 12 may be elastically deformable tabs and form snap-fit elements, like for example in the embodiments of FIGS. 8 and 9. The sealing element 14, also designated as a sealing member, may comprise means to cooperate with the snap-fit elements to retain the sealing element in the open position. The snap-fit elements may be annular snap-fit elements, cantilever snap-fit elements or torsional snap-fit elements.

The snap-fit elements may be configured to cooperate with corresponding means on the conduit and configured to position or retain the sealing element in the open position when the sealing element 14 has been moved from its closed position to its open position.

As shown in FIG. 9, the snap-fit elements may comprise a first abutment surface 40 that is in contact with the sealing element 14 in the closed position, and a second abutment surface 42 that is in contact with the sealing element 14 in the open position. In the closed position, the sealing element must apply a predetermined force on the first abutment surface of the snap-fit elements to bend them and to move to the open position. In the open position, the second abutment surface of the snap-fit elements is configured to securely lock the sealing element 14.

When the conduit shows a central axis X, the one or more abutment elements 28 of the interface member 12 may be pins, or an inner hoop fixed to the conduit and in the direction of the central axis of the conduit, for example, radial pins. The body of the sealing element 14 may then comprise a first recess configured to cooperate with the pins or with the inner hoop to position and maintain the sealing element in the closed position. The sealing element may also comprise a second radial recess configured to cooperate with the pins or with the inner hoop of the interface member to position and maintain the sealing element in the open position when the sealing element has been moved from its closed position to its open position. The sealing element comprises a sealing surface that is placed either between the cap and the first recess or between the first and second recesses.

In an embodiment not illustrated the sealing element comprises only two recesses formed by a first radial groove and a second radial groove configured to cooperate with the pins in the closed position and in the open position of the sealing element respectively.

When the body is a rod with a cross-formed cross-section, the ribs forming the cross may comprise recesses such as notches formed on their edge.

In embodiments, as shown in FIGS. 1 to 3, the downstream part and/or the upstream part of the socket 20 may comprise at least one retention relief. The retention relief may be an internal relief; preferably at least one internal relief is an internal thread 27 or a hoop.

For example, the first container 16 may comprise a neck with an external relief, and the upstream part of the socket 20 may comprise at least one internal relief wherein the internal relief of the socket cooperates with the external relief of the neck of the first container to fix the cap assembly on the first container 16.

Figure 7:
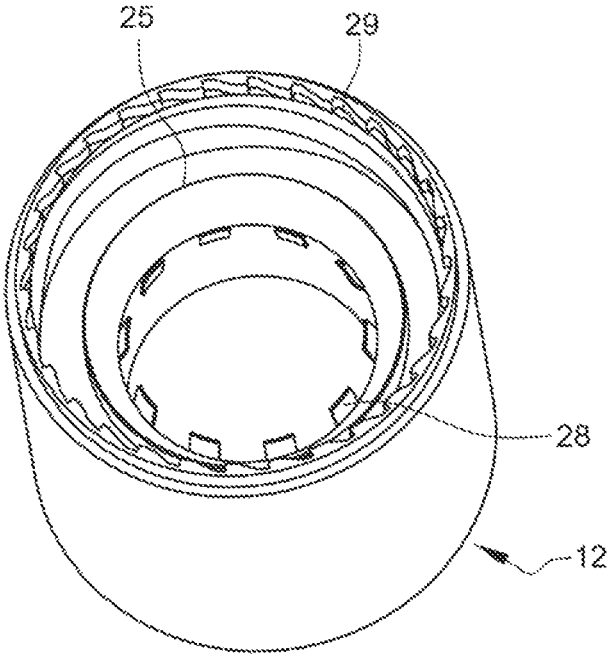
FIG. 7 is a top perspective view of an interface member according to another embodiment of the invention.

In addition to the internal thread 27, the socket 20 may comprise at least one holding relief 29, for example, shown in FIG. 7, on the inner wall 22 in the upstream part of the socket. The holding relief may comprise at least two ribs arranged around the inner wall to form an anti-unscrewing feature. In FIG. 7, the holding relief 29 is formed by an internal gear wheel or a sprocket looking relief.

The downstream part of the socket may also comprise at least one internal relief selected from an internal thread or an internal hoop. The sealing element 14 may also comprise means to engage with the internal thread or with the hoop of the downstream part.

Figure 4:
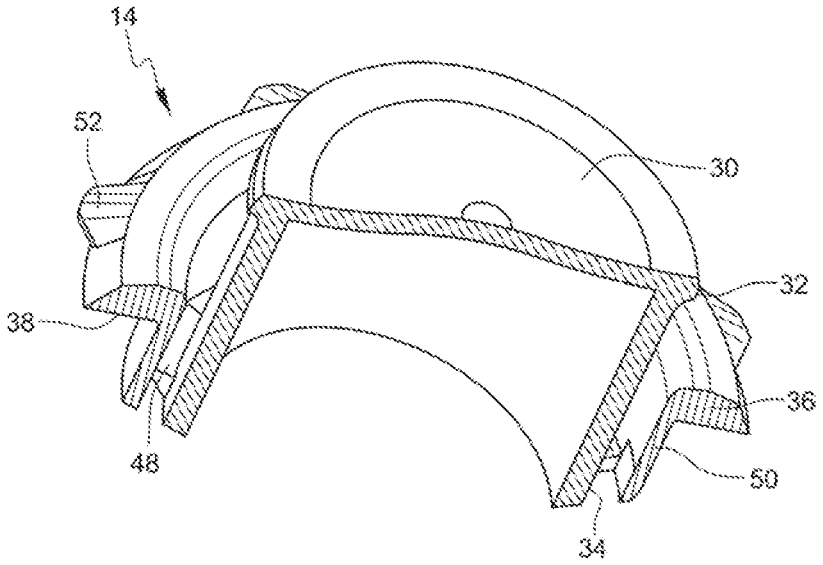
FIG. 4 is a cross-sectional top perspective view of a sealing element according to an embodiment of the invention.
Figure 5:
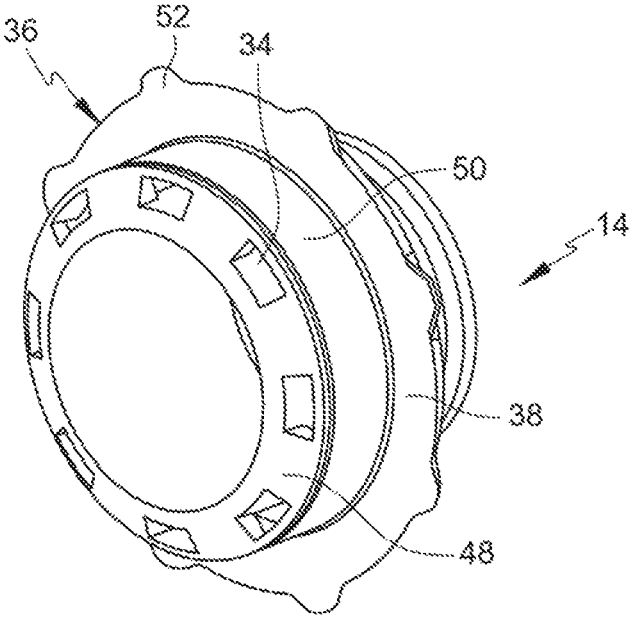
FIG. 5 is a bottom perspective view of the sealing element of FIG. 4.

When the downstream part of the socket comprises an internal relief, the at least one ring 36 extending radially outward from the body of the sealing element may further comprise holding lugs 52, as shown in FIGS. 4 and 5, configured to cooperate with the internal relief of the downstream part the socket to maintain the sealing element in the closed position. The holding lugs 52 are also designated as retention lugs. The retention lugs cooperate, and are in abutment with the retention relief.

The at least one aperture 34 of the sealing element may be arranged anywhere on the sealing element, downstream from the sealing surface 32. The sealing surface 32 may define a sealing section at the downstream end of the socket 20. For example, the sealing element comprises a hollow tubular body, and at least one aperture 34 is formed in the lateral wall of the body between the sealing surface 32 and the second end of the body.

For example, as in FIG. and 10, when the sealing element comprises a hollow tubular body, the sealing element may comprise a plurality of apertures arranged on the hollow tubular body of the sealing element.

As shown in FIGS. 4, 5, 6, and 10 the sealing element 14 may comprise a second end opposite to the first end, wherein an annular rim 48 extends outward from the second end of the hollow tubular body, and a cylindrical outer skirt 50 extends from the annular rim 48 in the direction of the first end. The sealing element thus comprises a U profile. When arranged inside the socket 20, the conduit 24 is inserted in the U profile of the sealing element 14.

In the embodiments of FIGS. 4 and 5, the at least one aperture 34 is formed in the annular rim 48 of the sealing element; preferably, the sealing element comprises a plurality of apertures 34 arranged on the annular rim 48 of the sealing element.

Figure 6:
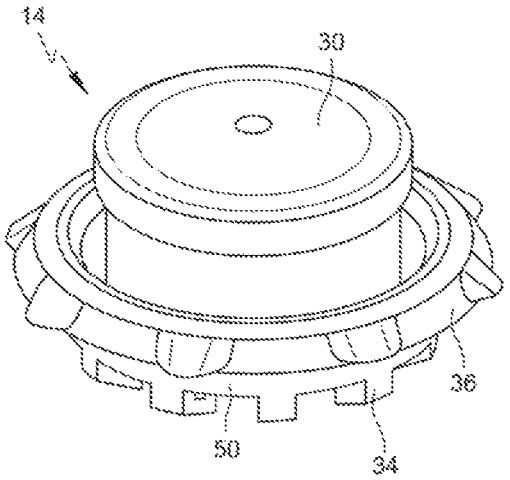
FIG. 6 is a top perspective view of a sealing element according to another embodiment of the invention.

In the embodiments of FIG. 6, the at least one aperture 34 is formed in both the annular rim and the outer skirt 50 of the sealing element 14.

In the embodiments of FIGS. 11 and 12, the downstream end of the cross-formed cross-section body comprises apertures 34 formed by an annular reinforcing skirt surrounding the ribs of the cross-formed body. More precisely with respect to FIGS. 11 and 12, the outer diameter of the sealing surface 32 is larger than the diameter of the tubular portion surrounding the apertures 34.

As shown in FIGS. 4 and 5, the at least one ring 36 or tab may extend radially outward from the hollow tubular body, from the end of the outer skirt 42 that is opposed to the annular rim 48 and may comprise the bearing surface 38.

Figure 13:
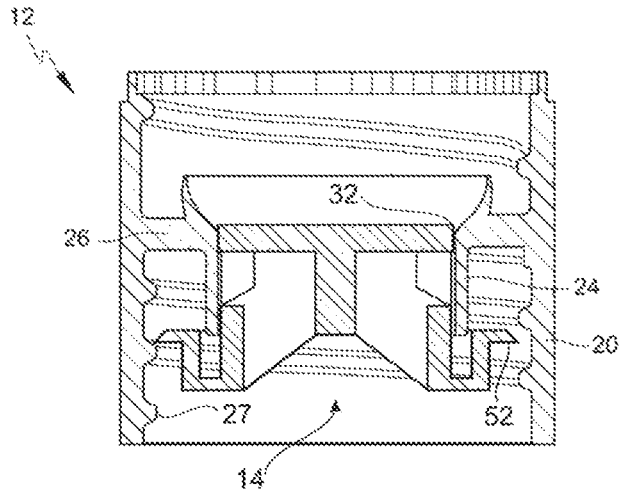
FIG. 13 is a cross-sectional view of a cap assembly according to another embodiment of the invention.

FIG. 13 represents an interface member 12 housing a sealing element 14 in the closed position. The sealing element 14 may be in accordance with the one as described in relation with FIG. 11 and/or FIG. 12.

In the closed position, the sealing surface 32 of the sealing element 14 obturates the conduit 24. The inner wall and the sealing surface 32 have slightly a same diameter. Their diameters are configured such that they provide a press fit assembly. A predefined maintaining force is achieved. The body of the sealing element 14 exhibits a smaller diameter than the inner wall of the conduit 24. Thus, sealing essentially occurs at the sealing surface 32. This arrangement is also configured for maintaining the sealing element 14 at the closed position.

In the closed position, at least, the holding lugs 52 cooperate with the internal threads 27. Then, the holding lugs 52 and internal threads 27 are in abutment, and prevent a sliding motion of the sealing element 14. The holding lugs 52 achieve a predefined maintaining force against an opening force. When a refiled container (not illustrated) is inserted in the downstream part of the socket 20, it provides an opening force which overcomes the abutment between the holding lugs 52 and internal threads 27. It overcomes the maintaining force of the interface member 12.

Figure 14:
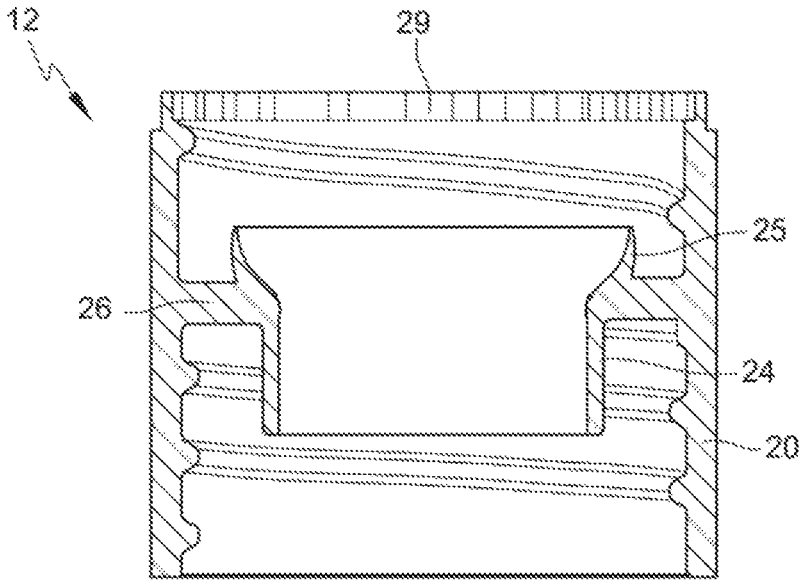
FIG. 14 is a detailed view of FIG. 8 showing an abutment element according to another embodiment of the invention.

FIG. 14 provides an illustration of an interface member 12 in accordance with the invention; wherein the closing member is removed for the sake of clarity of the figure.

The interface member 12 includes a socket 20 surrounding a coaxial conduit 24. The connecting wall 26 defines a sealing bulkhead between them. It forms an annular separation. The conduit 24 projects within the socket 20. Its upstream end lies in the upstream part of the socket 20; and its downstream end lies in the downstream part of the socket 20. The upstream end of the conduit 24, also designated as upper end, is a tapered end 25. The tapered end 25 exhibits a thickness reduction toward the holding relief 29, or more generally toward the inlet of the upstream part of the socket 20.

All along the discharge opening, or more generally all along the conduit 24, the latter exhibits a smooth inner wall. The surface of the inner wall may be protrusion free and/or recess free. The inner wall is free of abutment elements as described in the previous figures. Then, the opening motion of the associated closing member is easier to manage. The interface member 12 becomes easier to produce.

The skilled person understands that all the characteristics of the interface member, and the sealing element described above may be applied to a cap assembly comprising an interface member, and a sealing element, and vice versa, the characteristics of the interface member or the sealing element of the cap assembly described above may be respectively applied to an interface member or a sealing element.

What is claimed is:

1. A cap assembly for a refill container, the cap assembly comprising:

an interface member; and a sealing element retained in the interface member and comprising:

a body having a first end; and a cap arranged at the first end of the body;

wherein the interface member comprises a socket, a conduit forming a discharge opening arranged inside the socket and spaced from the socket, and a connecting wall extending between the socket and the conduit to prevent flow between the socket and the conduit; the conduit having an upstream end, a downstream end and an inner wall; the socket comprising an upstream part adapted to receive a first container, and a downstream part adapted to receive a second container, the downstream part comprising one or more internal reliefs;

wherein the sealing element is arranged to be partly inside the conduit and is moveable between a closed position in which the conduit is sealed, and an open position in which flow is allowed through the conduit, said sealing element comprising a bearing surface in the downstream part;

wherein at least one of the body and the cap comprises a lateral wall with a sealing surface configured to cooperate with the inner wall of the conduit to seal it when the sealing element is in the closed position;

wherein the sealing element further comprises at least one of an aperture and at least one recess forming a passage configured to be crossed by the flow when the sealing element is in the open position;

wherein the sealing element further comprises safety means comprising one or more retention lugs in abutment with the one or more internal reliefs in order to maintain the sealing element in the closed position; and wherein the cap assembly is configured such that the sealing element moves from the closed position to the open position when an opening force is applied on the bearing surface.

2. The cap assembly according to claim 1 wherein the interface member further comprises one or more abutment elements arranged in the conduit or at the upstream end of the conduit and are configured to keep the conduit partially open, the one or more abutment elements cooperate with the sealing element to position it in the closed position.

3. The cap assembly according to claim 2 wherein the one or more abutment elements of the interface member are elastically deformable tabs and form snap-fit elements; and wherein the sealing element comprises means to cooperate with the snap-fit elements to retain it in the open position.

4. The cap assembly according to claim 3 wherein the snap-fit elements are one of annular snap-fit elements, cantilever snap-fit elements or torsional snap-fit elements.

5. The cap assembly according to claim 2 wherein the conduit shows a central axis (X) and in that the one or more abutment elements of the interface member are legs that extend in the direction of the central axis of the conduit.

6. The cap assembly according to claim 2 wherein the conduit shows a central axis (X) and in that the interface member comprises one abutment element being a leg fixed at both ends to the conduit wherein one end is fixed to the conduit by a frangible zone; and wherein the abutment elements extend through at least one of the axis (X).

7. The cap assembly according to claim 2 wherein the body is a hollow tubular body; wherein the conduit shows a central axis (X) and the one or more abutment elements of the interface member are pins or an inner hoop fixed to the conduit and in the direction of the central axis of the conduit and in that the body of the sealing element comprises a first recess configured to cooperate with the pins or with the inner hoop to position and maintain the sealing element in the closed position; and wherein the sealing element comprises a second recess configured to cooperate with the pins or with the inner hoop of the interface member to position and maintain the sealing element in the open position when the sealing element has been moved from its closed position to its open position.

8. The cap assembly according to claim 1 wherein the body of the sealing element is one of a hollow tubular body and a solid rod body with one of a round and a cross-formed cross-section.

9. The cap assembly according to claim 1 wherein:

the body of the sealing element is a solid rod with one of a round cross-section and a cross-formed cross-section; and the sealing surface is a ledge formed around the cap of the sealing element.

10. The cap assembly according to claim 1 wherein the body of the sealing element is a hollow tubular body that is closed at one end by the cap, in that an inner diameter of the conduit is greater than the outer diameter of the body of the sealing element to define a passage between the conduit and the body in which flow is allowed and in that the sealing surface of the sealing element is formed by a shoulder on the hollow tubular body; and wherein one of the shoulder is arranged at the first end of the hollow tubular body and the first end of the hollow tubular body is closed by the cap.

11. The cap assembly according to claim 1 wherein the sealing element further comprises snap-fit elements configured to cooperate with corresponding means on the conduit and configured to retain the sealing element in the open position when the sealing element has been moved from its closed position to its open position.

12. The cap assembly according to claim 1 wherein the sealing element further comprises at least one ring or at least two protrusions extending outward from the body.

13. The cap assembly according to claim 1 wherein the upstream end of the conduit is arranged in the upstream part of the socket of the interface member; and the downstream end of the conduit is arranged inside the downstream part; and wherein the upstream part of the socket comprises one or more internal reliefs.

14. The cap assembly according to claim 13 wherein the one or more internal reliefs are one of internal threads or hoops.

15. The cap assembly according to claim 1 wherein at least one of the upstream part of the socket and the downstream part of the socket comprises an internal thread and further comprises at least one holding relief on the inner wall, and at least one ring extending radially outward from the body of the sealing element further comprises holding lugs configured to cooperate with the internal relief of the socket to maintain the sealing element in the closed position; wherein the at least one retention lug comprises a circular array of retention lugs.

16. A set comprising:

a first container with a neck including a first external relief and a second internal relief; and a cap assembly comprising:

an interface member comprising:

a socket comprising a conduit forming a discharge opening arranged inside the socket and spaced from the socket, and a connecting wall extending between the socket and the conduit to prevent flow between the socket and the conduit;

wherein the conduit comprises an upstream end, a downstream end and an inner wall;

wherein the socket comprises an upstream part on one side of the connecting wall inside of which is arranged the upstream end of the conduit wherein the upstream part of the socket comprises an internal thread and further comprises at least one holding relief on the inner wall, and the internal thread of the socket cooperates with the first external relief of the neck of the first container to screw the first container into the cap assembly, and the holding relief of the socket cooperates with the second internal relief of the neck to fix the cap assembly on the first container, a sealing element retained in the interface member and comprising:

a body having a first end; and a cap arranged at the first end of the body;

wherein the sealing element is arranged to be partly inside the conduit and is moveable between a closed position in which the conduit is sealed, and an open position in which flow is allowed through the conduit, said sealing element comprising a bearing surface in the downstream part;

wherein at least one of the body and the cap comprises a lateral wall with a sealing surface configured to cooperate with the inner wall of the conduit to seal it when the sealing element is in the closed position;

wherein the sealing element further comprises at least one of an aperture and at least one recess forming a passage configured to be crossed by the flow when the sealing element is in the open position;

wherein the sealing element further comprises safety means comprising one or more retention lugs in abutment with the one or more internal reliefs in order to maintain the sealing element in the closed position; and wherein the cap assembly is configured such that the sealing element moves from the closed position to the open position when an opening force is applied on the bearing surface.

* * * * *